US005116090A

United States Patent [19]

Nichandros

[11] Patent Number: 5,116,090

[45] Date of Patent: May 26, 1992

[54] GATE LATCH CAM

[76] Inventor: Frederick C. Nichandros, 19640 Center St., Castro Valley, Calif. 94546

[21] Appl. No.: 617,562

[22] Filed: Nov. 26, 1990

[51] Int. Cl.[5] ..... E05C 3/14

[52] U.S. Cl. ..... 292/236; 292/DIG. 60; 292/205

[58] Field of Search ..... 292/132, 134, 198, 205, 292/236, 332, 334

[56] References Cited

U.S. PATENT DOCUMENTS

| | | | |
|---|---|---|---|
| 193,565 | 7/1877 | Snow | 292/299 |
| 227,266 | 5/1880 | Kirk | 292/197 |
| 635,363 | 10/1899 | Tripp | 292/299 |
| 2,287,710 | 6/1942 | Sayles | 292/236 |
| 2,592,871 | 4/1948 | Dole | 292/134 |
| 3,266,831 | 8/1966 | Banse | 292/235 |
| 3,433,518 | 3/1969 | Foltz | 292/235 |
| 4,305,611 | 12/1981 | Robins | 292/DIG. 60 |

FOREIGN PATENT DOCUMENTS

| | | | |
|---|---|---|---|
| 1046552 | 1/1979 | Canada | 292/133 |
| 1549636 | 8/1979 | United Kingdom | 292/DIG. 66 |

*Primary Examiner*—Renee S. Luebke
*Assistant Examiner*—Darnell M. Boucher
*Attorney, Agent, or Firm*—Linval B. Castle

[57] ABSTRACT

A gate latch, using neither gravity nor springs, is forceably opened and closed from either side of the gate by a handled lever that passes between the gate and gate post an into an arcuate cam slot. When the lever is lifted, it forces open the latch to eject a gate pin and, when lowered, forces the latch to close on the gate pin.

4 Claims, 1 Drawing Sheet

GATE LATCH CAM

BRIEF SUMMARY OF THE INVENTION

This invention relates to gate hardware and in particular to a novel cam that enables a common gate latch to be opened and closed from either side of the gate.

One of the most popular and satisfactory latches for garden gates is manufactured by National Manufacturing Corp., Ideal Security Hardware Company, and others, and includes a rotatable cam member attached at right angles to a stationary gate post and having a radial slot for capturing a pin member extending from the adjacent gate stile. The gate is released by pushing a short arm on the rotatable cam so that the cam slot releases the gate pin. Releasing the short arm permits the cam to drop by gravity into its locked position. It may be temporarily opened by the action of striking of the gate pin against the cam and closed by gravity to secure the gate pin and the gate.

The above gate latch is attached on a post at one side of a gate and manually opening the gate from that side is very simply accomplished by merely pushing back the short arm of the cam to release the gate pin. Release of the latch from the opposite side of the gate is accomplished by pulling on a cord or wire attached through a hole through the gate post to the short arm. A stiff wire is preferred because it is often necessary to push the short handle on the opposite side of the gate in order to latch it if the gate has sagged or any other friction prevents the gravity closure of the latch.

The improved gate latch cam to be described is intended to replace only the cam in the above described gate latch. The improved cam, together with a new pivoting latch bar extending between the stationary gate post and the gate stile for actuating the cam from the opposite side of the gate, provides positive opening and closing control of the latch that doesn't require dependence upon gravity for closure.

Briefly described the improved latch cam includes the essential rotatable cam components of the prior art but the short arm on the prior art cam has been replaced with a new double-surfaced, arcuate that cooperates with a flat blade on the end of a pivoting latch bar to permit the latch to be forcibly opened and closed by the latch bar. This feature becomes important if the gate has sagged or if friction has resisted full closure because the double action enables one to force closure of the latch as well as its opening.

BRIEF DESCRIPTION OF THE DRAWINGS

In the drawings which illustrate the preferred embodiment of the invention.

DETAILED DESCRIPTION OF THE PREFERRED EMBODIMENT

Figure 1:
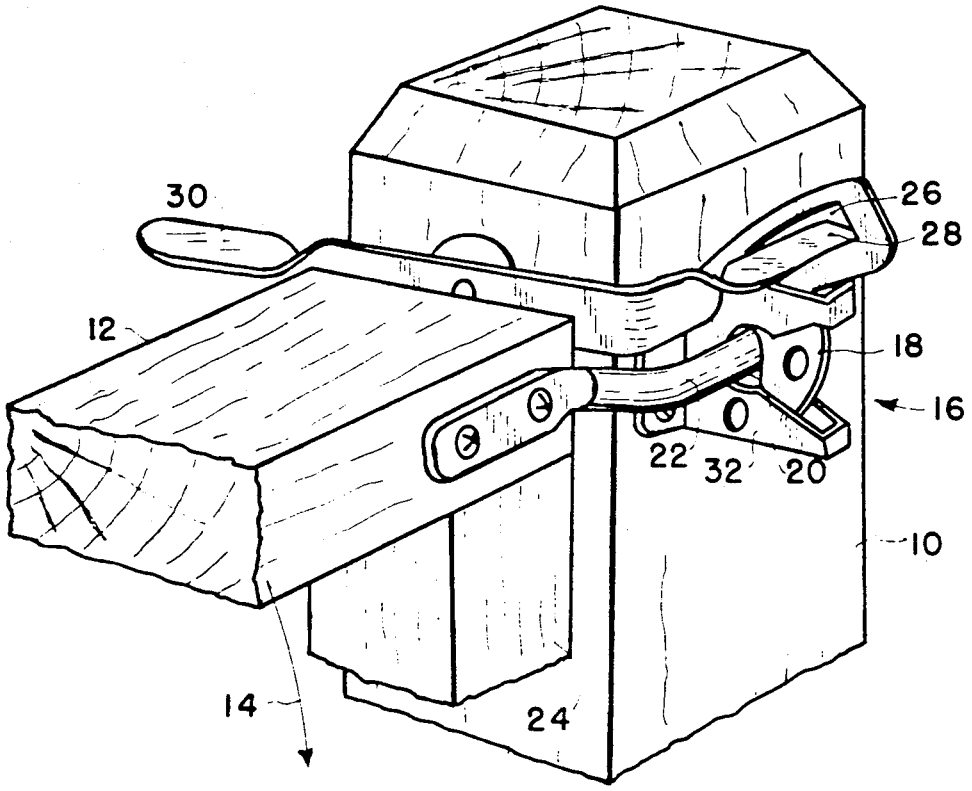
FIG. 1 is a perspective view illustrating the gate latch with the improved cam and the pivoting latch bar attached to a gate post.

Illustrated in FIG. 1 is a portion of a stationary gate post 10 adjacent a portion of a gate 12 hinged to swing inward toward the right as indicated by the arrow 14. Mounted to the face of the post 10 is a gate latch 16 of the type having a rotatable cam 18 mounted at right angles to the face of the post and containing a slot 20 that may be rotated to capture a pin 22 extending from the gate stile 24. Once having captured the pin 22, the cam 18 is rotated back to secure the pin and the gate against opening.

As mentioned above, the prior art latch of this type was opened by a short arm attached to the top of the rotating cam 18 so the cam could be rotated manually from the latch side by movement of the arm or from the outside by a string or wire passed through the gate post to the top of the arm thus permitting gravity to re-rotate the cam for securing the gate pin 22. The improvement now to be described has eliminated the manually operable arm and replaced it with a curved, double-surfaced, arcuate slot 26 which cooperates with the tongue 28 at the end of a lever arm 30 that extends through the opening between the gate stile 24 and post 10 so that the gate latch may be released and forcibly closed from either side of the gate.

As shown in FIG. 1, the improved cam 18 is mounted within a prior art metal yoke 32 fastened to the face of the gate post 10. The yoke is formed with a V-shaped opening for centering the gate pin 22 and when the pin strikes the cam 18, the shape of the cam pivots it so that the cam slot 20 becomes aligned to receive the pin 22. When the gate pin 22 becomes seated in the cam slot, the cam is free to be counter-rotated to capture the pin to secure the gate.

Rotation of the cam 18 is accomplished by actuating the thin metal lever 30 from either side of the gate 12 he lever, which is pivotally attached to the gate post 10 is approximately 7¾ inches in length excluding about a two-inch tongue end which is bent at right angles about 3½ from the pivot point and the end is twisted about 70° so that a nearly horizontal tongue 28 enters the cam slot 26. Depressing the handle end of the lever 30 opposite the tongue causes the tongue 28 to raise within the arcuate slot 26 to rotate the cam 18, counterclockwise in the drawings, to receive or to eject the gate pin 22 from the latch. Similarly, lifting the end of the handle end of the lever 30 causes the tongue 28 to lower against the lower surface of the arcuate slot 26 to forcibly rotate the cam 18 clockwise into a gate-pin locking position.

Since the improved cam is intended to replace only the short arm cam in the prior art latch, the dimensions of the improved cam are important to the construction of an improved latch.

Figure 2:
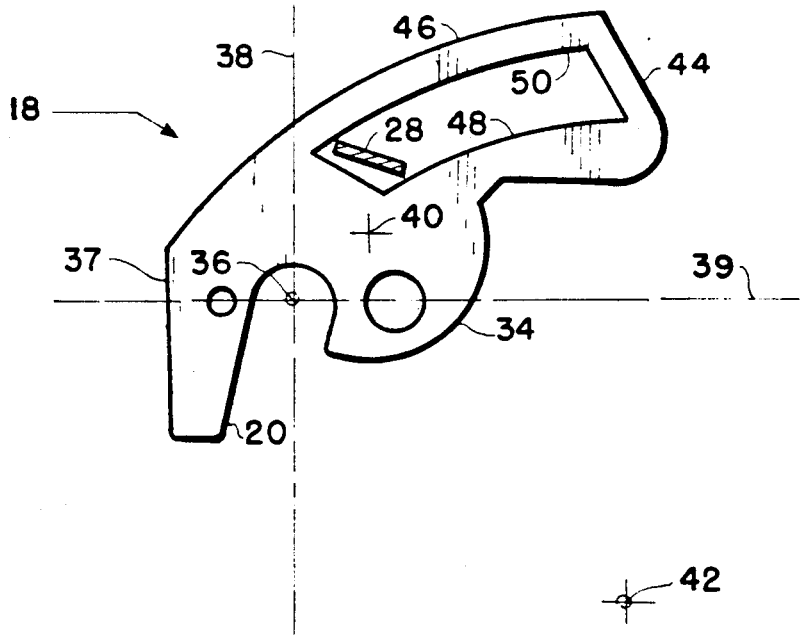
FIG. 2 is a detailed plan view of the improved latch cam with critical dimensions included.

FIG. 2 is an enlarged view of the rotating cam 18 that will be mounted into the prior art yoke 32 of the latch 16. The rotating cam 18 is preferably 0.110 inches in thickness and is stamped from a hard, non-oxydizable material such as galvanized steel. The rotating cam 18 actually includes two cam surfaces a first cam surface 34 that automatically flips open the latch when it is struck by the closing gate pin 22, and the two edges of the arcuate slot 26 for opening and locking the latch 18 either manually or by use of the lever 30.

The first step in reproducing the rotating cam 18 involves a plot of the cam. Initially, an index point 36 will be selected which will also become the center of a 0.437-inch diameter hole for accommodating the gate pin 22 in the latch Tangents are drawn down toward the left at an angle of 15° from the vertical from the diameter of the gate pin hole to form the slot 20. From the index point 36 a vertical ordinate axis 38 and a horizontal abscissa axis 39 are drawn. Centered on the abscissa axis 39, 0.437 inches to the left of the ordinate axis 38 is a pivot hole, around which the cam 18 rotates; on the same axis 39, 0.532 inches to the right of the ordinate axis 38 is centered a larger hole for a padlock shackle for securing the latch. A vertical line $\frac{3}{4}$ inches to the left of the ordinate axis forms the left side edge 37 of the rotating cam 18.

A first cam center 40 is located $\frac{3}{8}$ inches to the right of the ordinate axis 38 and $\frac{3}{8}$ inches above the abscissa axis 39. From this center 40 a circular arc is drawn from the right edge of the slot 20 to a point about $\frac{1}{2}$ inch above the abscissa axis 39 to form a first cam surface 34 which, when struck by a closing gate pin, rotates the cam 18 counterclockwise to open the slot 20.

The above description, while essential to the disclosure of the improved gate latch cam, also includes an description of existing, well-known gate latches. A detailed description of the improved gate latch cam follows.

A second center 42 for defining arcuate slot 26 is located 1.750 inches below the abscissa axis 39 and 2.000 inches to the right of the ordinate axis 38. From this point arcs are swung approximately between the vertical and the ordinate axis 38 to plot the arcuate slot 26 which form a second cam member that controls the opening and forcible closing of the latch 18 by use of the lever 30 shown in FIG. 1.

The extreme right edge of the rotating cam element 18 in FIG. 1 is defined in FIG. 2 by a line 44 drawn from a point on the abscissa axis 39, 2.75 inches to the right of the ordinate axis and extending up and toward the ordinate axis 38 at an angle of 60° above horizontal. An arc centered at the second center 42 and having a radius of 3.437 inches extends from the line 44 to the left edge 37 is becomes the top edge 46 of the rotating cam member 18.

Within the arcuate slot 26 are the actuating tongue 28 and the two surfaces 48, 50 which respectively operate to lock and open the latch according to the movement of the tongue through the slot. Downward force by the tongue 28 on the lower surface 48 operates to lock the latch while upward force on the surface 50 rotates the unit counterclockwise to open the latch. The lower or locking surface 48 is formed on an arc about the center 42 and having a radius of 2.812 inches. The right end of the locking surface 48 is spaced 0.187 inches from the line 44; the left end of the surface 48 is 0.50 inches to the right of the ordinate axis 38. The upper or opening surface 50 is formed on an arc about the center 42 and has a radius of 3.250 inches. The right end of this surface is also spaced 0.187 inches from the line 44 and the left end is at a point 30° above and to the left of the left end of the surface 48.

Having thus described my improved gate latch, what I claim is as follows:

1. A gate latch for securing a swinging gate to a gate post, said gate latch comprising:

a cam member mountable normal to the surface of the gate post in a yoke attachable to said gate post, said cam member being rotatable about a pivot in said yoke and having a gate pin slot rotatable between an open and a locked position;

a gate pin attachable to the swinging gate and having an end extendible into said gate pin slot in its open position, said gate pin end for striking an arcuate surface on said cam member in its locked position for forcing rotation of said cam member into its open position to receive said pin;

the improvement comprising: an arcuate slot in said cam member, said slot extending above and outward from said gate pin slot and having an arcuate opening edge and closing edge said arcuate opening edge and said arcuate closing edge being plotted from centers below said cam member; and a latch bar extendible from the side of the gate opposite said latch, through an opening between said gate and said gate post and terminating in a flat tongue within said arcuate slot, a lifting of said tongue acting upon the opening edge of said arcuate slot to rotate said cam member into its open position, and a lowering of said tongue acting upon the closing edge of said arcuate slot to urge rotation of said cam member into its closed position.

2. The gate latch claimed in claim 1 wherein said yoke for mounting said cam member has a V-shaped face for guiding said gate pin to said cam member and to said gate pin slot, and wherein said cam member, in its locked position, has a padlock hole approximately centered at said V-shaped face of said yoke for receiving a lock for preventing opening of said cam member.

3. The gate latch claimed in claim 1 wherein said latch bar is a thin metal bar passing between said gate and said gate post and is pivoted to said gate post at a location approximately level with the lowest part of said arcuate slot, said latch bar being bent around the corner of said gate post and bent into a tongue within said arcuate slot.

4. In combination with a gate latch wherein a gate pin horizontally extending from a gate engages a gate pin slot in a cam member pivotally mounted in a yoke perpendicularly attached to the face of a gate post adjacent the gate, a means for pivotally rotating said cam member between a locked and open position comprising:

an arcuate slot in said cam member and extending above and outward from said gate pin slot said slot having an arcuate opening edge and an arcuate closing edge, said arcuate edges being plotted from a common center below said cam member; and a latch bar extendible from the side of the gate opposite said latch and terminating in a flat tongue within said arcuate slot, a lifting of said tongue acting upon the arcuate opening edge of said arculate slot to rotate said cam member into its open position, and a lowering of said tongue acting upon the arcuate closing edge of said arcuate slot to urge rotation of said cam member into its closed position.

* * * * *